United States Patent [19]

Laplante et al.

[11] Patent Number: 5,065,557

[45] Date of Patent: Nov. 19, 1991

[54] CURTAIN WALL SYSTEM WITH INDIVIDUALLY REMOVABLE WALL PANELS

[75] Inventors: Russell Laplante, Arnold; James A. Rockar, Grover; Robert H. Stegeman, Jr., Old Monroe, all of Mo.

[73] Assignee: Robertson-CECO Corporation, Pittsburgh, Pa.

[21] Appl. No.: 607,526

[22] Filed: Nov. 1, 1990

[51] Int. Cl.[5] ..... E04B 2/88

[52] U.S. Cl. ..... 52/235; 52/483; 52/510

[58] Field of Search ..... 52/235, 483, 400, 510, 52/481

[56] References Cited

U.S. PATENT DOCUMENTS

| | | | |
|---|---|---|---|
| 3,295,282 | 1/1967 | Belcher, Jr. | 52/235 |
| 3,559,358 | 2/1971 | Lohse et al. | 52/235 |
| 3,672,107 | 6/1972 | Santry et al. | 52/511 |
| 3,715,848 | 2/1973 | Jordan | 52/235 |
| 3,735,544 | 7/1973 | Longinotti | 52/235 |
| 3,967,424 | 7/1976 | Gates | 52/511 |
| 4,089,146 | 5/1978 | Martinez | 52/235 |
| 4,121,396 | 10/1978 | Oogami et al. | 52/235 |
| 4,307,551 | 12/1981 | Crandell | 52/235 |
| 4,448,001 | 5/1984 | Whitmyer | 52/235 |
| 4,483,122 | 11/1984 | Crandell | 52/747 |
| 4,545,161 | 10/1985 | Baumann | 52/235 |
| 4,625,481 | 12/1986 | Crandell | 52/235 |
| 4,768,321 | 9/1988 | Crandell | 52/235 |

FOREIGN PATENT DOCUMENTS

| | | | |
|---|---|---|---|
| 675036 | 11/1963 | Canada | 52/235 |
| 2216214 | 10/1973 | Fed. Rep. of Germany | 52/235 |
| 2738748 | 1/1979 | Fed. Rep. of Germany | 52/235 |

OTHER PUBLICATIONS

"Axiom Wall Systems", Catalog No. AW-344, 1990.

*Primary Examiner*—Richard E. Chilcot, Jr.
*Assistant Examiner*—Kien Nguyen
*Attorney, Agent, or Firm*—George E. Manias

[57] ABSTRACT

A curtain wall system incorporating a dry seal system to preclude ingress of water and the infiltration of exterior air. The curtain wall system includes displaceable vertical splines, which when displaced release the opposite vertical side edges of any selected panel. The released panels may then be removed and replaced. The arrangement allows the removal and installation of panels in a non-sequential manner.

22 Claims, 7 Drawing Sheets

CURTAIN WALL SYSTEM WITH INDIVIDUALLY REMOVABLE WALL PANELS

BACKGROUND OF THE INVENTION

1. Field of the Invention

This invention relates to curtain wall systems, and more particularly to curtain wall systems having readily replaceable panels.

2. Background Discussion

Curtain wall systems are known wherein damaged panels may be removed and a new panel installed. All such known systems employ wet seal arrangements, that is, wherein a silicone sealant or structural silicone adhesive is introduced into the joints between the edges of adjacent panels to seal the joints and to secure the panel edges one to the other.

When a panel is damaged and must be replaced, it is first necessary to remove the silicone sealant from around the entire perimeter of the damaged panel. The damaged panel is then removed and the resulting cavity is prepared by cleaning procedures and, in some instances, replacement or the addition of various supporting elements to receive the new panel. After the new panel has been inserted into the cavity, it is first secured by screw fasteners to vertical spline elements that are fixed to horizontal panel supporting members. Thereafter, a new silicone sealant is introduced around the entire perimeter of the new panel to seal the joint between it and the horizontally adjacent and vertically adjacent panels. Such a system is described in U.S. Pat. Nos. 4,307,551; 4,483,122 and 4,625,481.

Other curtain wall systems are known which utilize a dry gasket seal system, that is, wherein gaskets are employed to seal against the ingress of moisture and water and the infiltration of air. In such systems, damaged panels cannot be replaced without dismantling a major portion of the curtain wall.

Thus it would be very desireable and highly advantageous and very economical from the standpoint of materials and labor costs, to provide a curtain wall system utilizing a dry gasket seal system wherein panels can be replaced without having to dismantle any portion of the curtain wall other than the panel being replaced.

SUMMARY OF THE INVENTION

It is the principal object of this invention to provide a curtain wall system utilizing dry gasket seals that allows individual panels to be removed and installed in a non-sequential manner.

It is another object of this invention to provide a novel vertical joint arrangement that allows the vertical edge of either of the horizontally adjacent panels to be released for removing the selected one of the horizontally adjacent panels.

It its broadest aspects, the present invention relates to and provides a vertical joint between horizontally adjacent wall panels of a wall structure. The wall structure comprises panels having inner and outer panel faces and which present spaced-apart vertical edges with a vertical gap therebetween. Rail means secured to the inner panel faces at the vertical edges, present vertical recesses open at and extending inwardly from the vertical edges of the panels. Vertical spline means extending substantially along the entire length of the vertical joint, spans across the gap and engages the vertical recesses thereby releasibly retaining the panels.

Further in accordance with the present invention, the width of the vertical spline means is less than the sum of the widths of the vertical gap and the vertical recesses by an amount sufficient to permit the vertical spline means to be moved toward one of the rail means thereby disengaging the spline means from and releasing the other rail means and the panel connected thereto for removal from the wall structure.

Still further in accordance with the present invention, a system is provided for erecting a plurality of wall panels to form a wall structure having horizontally adjacent panels and vertically adjacent panels. The system comprises panels, each having an inner panel face and an outer panel face. Rail means secured to the perimeter of the inner face of each panel, provide horizontal top and bottom recesses at the upper and lower ends of the panel, and vertical side recesses at the opposite sides of the panel. Horizontal frame means disposed inboard of the panels, engage the top and bottom recesses and support the vertically adjacent panels in vertically spaced-apart relation with horizontal gaps therebetween. Vertical frame means disposed inboard of the wall panels, are each engaged by the rail means of horizontally adjacent panels. Vertical spline means, each secured to one of the vertical frame means, engage the vertical side recesses and releasibly retain the horizontally adjacent panels in spaced-apart relation with vertical gaps therebetween.

BRIEF DESCRIPTION OF THE DRAWINGS

FIG. 7A is a fragmentary cross-sectional view, similar to

FIG. 7, illustrating an alternative cover plate and rail means arrangement;

DESCRIPTION OF THE PREFERRED EMBODIMENT(S)

Figure 1:
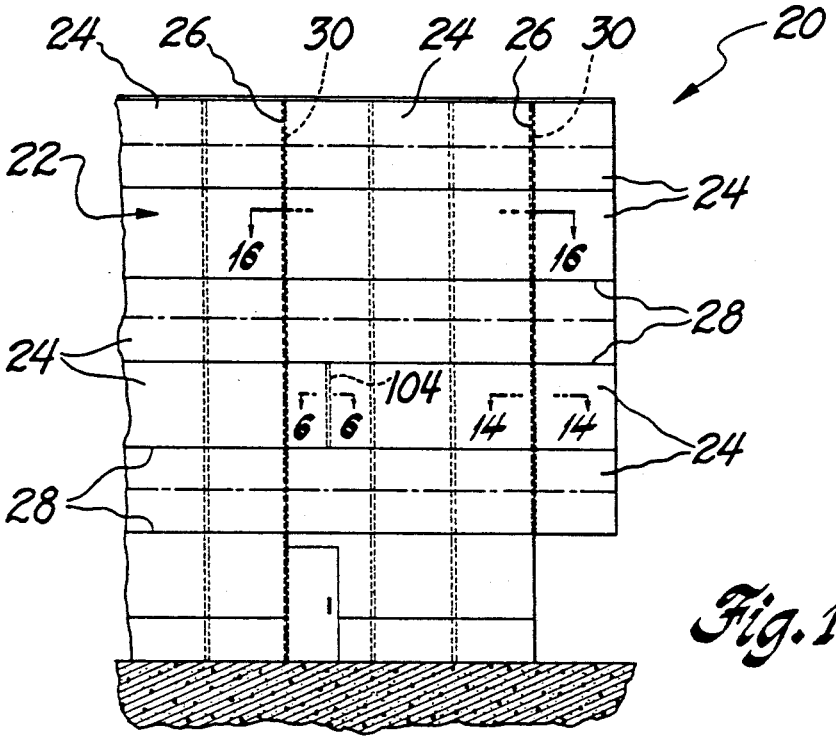
FIG. 1 is an elevation view of a building incorporating the curtain wall construction of this invention.

Referring to FIG. 1, there is illustrated a three story building 20 with an exterior wall structure 22 of this invention, assembled from horizontally adjacent and vertically adjacent wall panels 24 which present vertical joints 26 and horizontal joints 28. While the wall panels 24 are illustrated extending horizontally between spaced-apart columns 30, they can extend vertically, if desired. The vertical or horizontal orientation is made possible by unique rail means (to be described) secured to the perimeter of the inner face of the wall panel 24.

Figure 2:
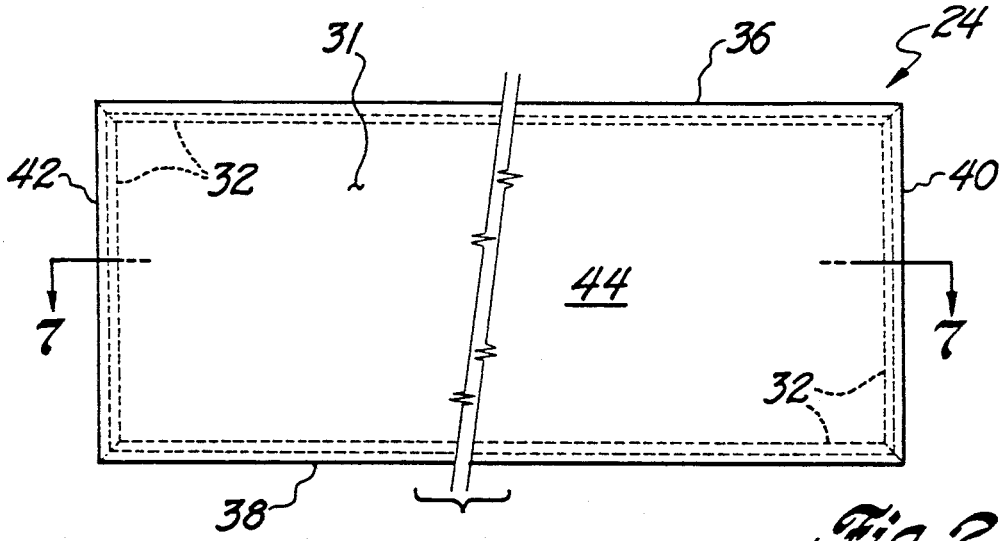
FIG. 2 is an elevation view of a building wall panel employed in the curtain wall construction of FIG. 1.
Figure 5:
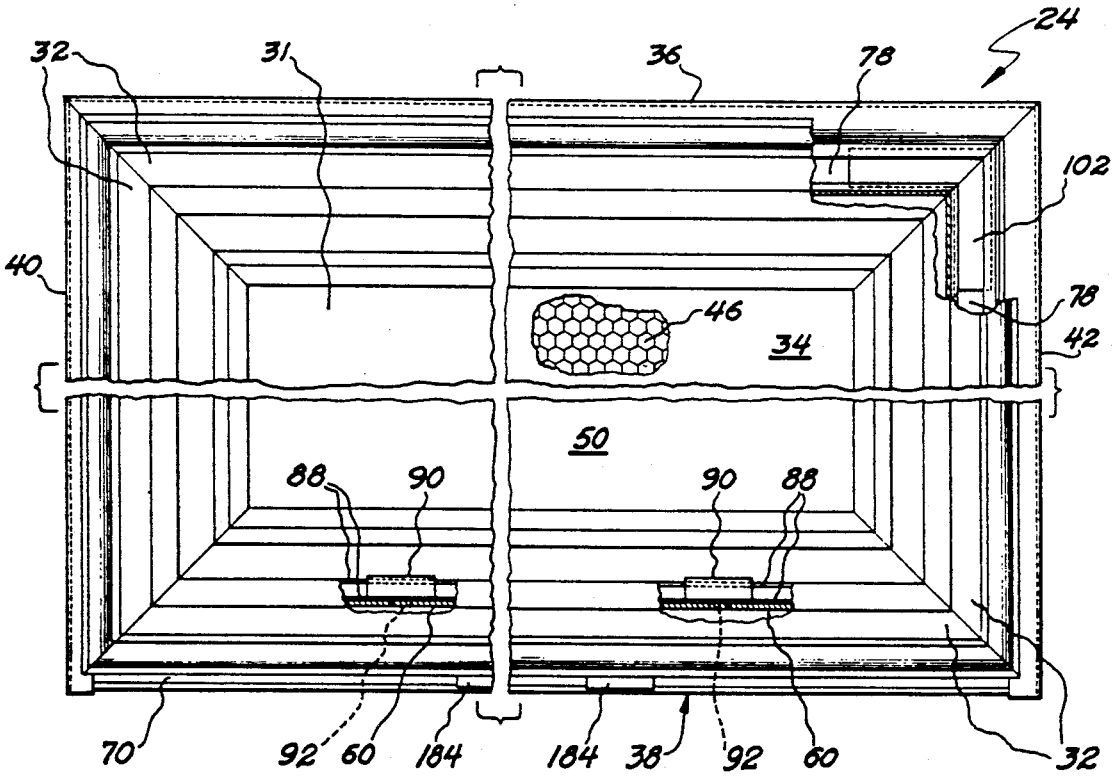
FIG. 5 is a broken elevation view, illustrating the interior face of the building wall panel of FIG. 2.

Referring to FIGS. 2 and 5, the wall panel 24 presents upper and lower panel edges 36, 38 and opposite panel side edges 40, 42. The wall panel 24 includes a cover plate 31 having a panel outer face 44 and a panel inner face 34. Rail means 32 secured to the panel inner face 34, extends around the entire perimeter of the cover plate 31.

Figure 3:
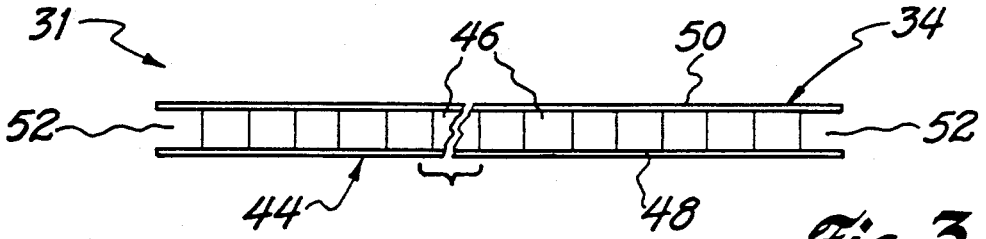
FIG. 3 is a broken side view illustrating a preferred embodiment of a cover panel of the building wall panel of FIG. 2.

As shown in FIG. 3, the cover plate 31 may comprise a metal honeycomb core 46, and outer and inner metal sheets 48, 50. The components 46, 48 and 50 preferably are formed from aluminum and are secured together by means of a suitable adhesive in a laminating process. An edge groove 52, extending around the entire periphery of the cover plate 31, cooperates with an element of the rail means 32 to connect the rail means 32 to the cover plate 31, as will be hereinafter described. It is to be understood that the present invention is not limited to the use of cover plates of laminated construction, but, instead, may utilized other types of cover plates including, for example, sheet aluminum, steel, fiberglass and glass.

Figure 4:
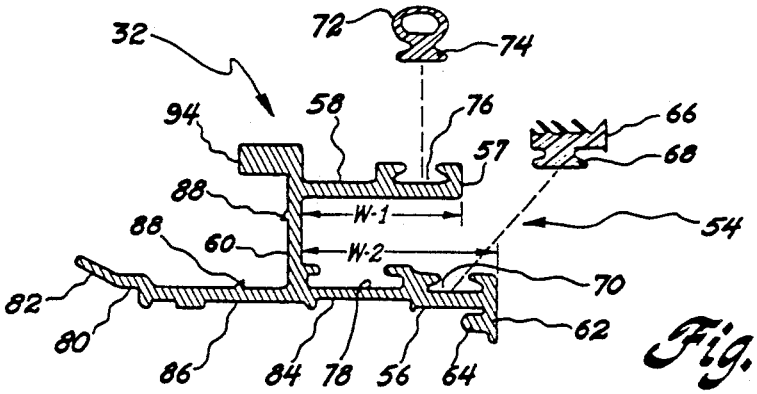
FIG. 4 is a transverse section illustrating the profile of panel rail means extrusion that extends around the perimeter of the building wall panel of FIG. 2.
Figure 7:
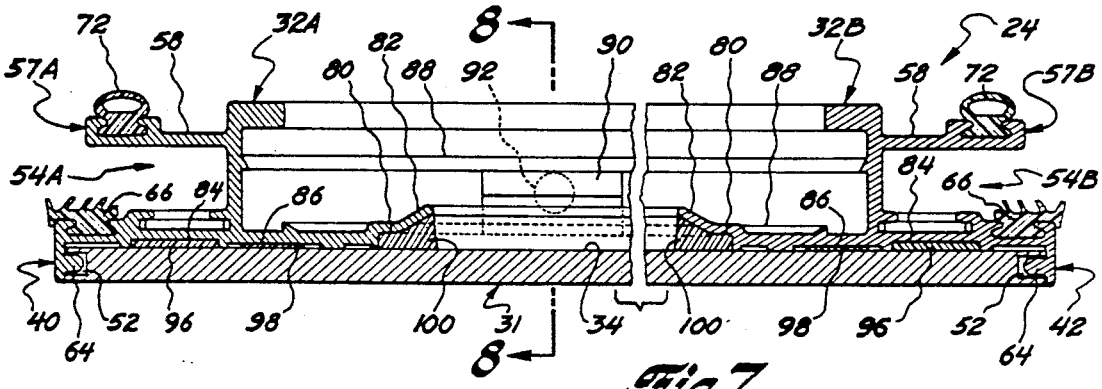
FIG. 7 is a cross-sectional view, taken along the line 7—7 of FIG. 2.

Referring to FIG. 4, the rail means 32 preferably is formed from aluminum by extrusion process. The rail means 32 presents a recess 54 defined by an outer arm 56, an inner arm 58 and web 60 connecting those ends of the outer and inner arms 56, 58 remote from a transverse leg 62 provided at a remote edge of the outer arm 56. It will also be observed that the inner arm 58 is spaced from and generally parallel with the outer arm 56, and has a width W-1, as measured from the web 60 to an outer edge 57 of the inner arm 58, which is less the width W-2 of the outer arm 56. Thus, as shown in FIG. 7, the outer edges 57A, 57B of the rail means 32A, 32B are laterally inwardly offset from the vertical edges 40, 42, respectively, of the wall panel 24. The inward offsetting of the outer edges 57A, 57B plays an important role in the releasible character of the present joint as will become apparent later in the specification.

Reverting to FIG. 4, the transverse leg 62 extends above and below the outer arm 56. A rib 64 extending from the leg 62 inwardly beneath the outer arm 56, is introduced into the edge groove 52 (FIG. 3) of the cover plate 31 thereby connecting the rail means 32 to the cover plate 31.

A first or outer dry gasket seal means 66 is provided having a keying portion 68 which is received in a first gasket-receiving groove 70 provided in that face of the outer arm 56 presented within the recess 54. A second or inner dry gasket seal means 72 is provided having a keying portion 74 which is received in a second gasket-receiving groove 76 provided in that face of the inner arm 58 that faces away from the recess 54. The outer arm 56 also is provided with a lengthwise groove 78 disposed within the recess 54, for receiving a corner connector 102 (FIG. 5). The outer arm 56 extending leftward, as viewed in FIG. 4, beyond the web 60, terminates in an inverted angle-shaped member 80 and an upturned flange 82 both of which cooperate with the cover plate 31 to define an adhesive-receiving recess. The lower face of the outer arm 56 is provided with spaced depressions 84, 86 adapted to receive permanent and temporary adhesives, respectively.

Figure 8:
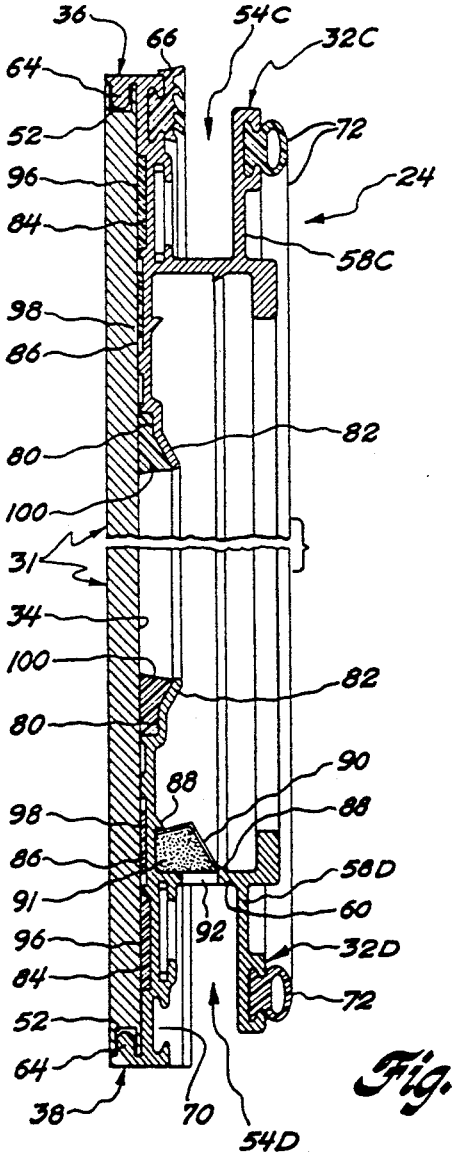
FIG. 8 is a cross sectional view, taken along the line 8—8 of FIG. 7.

Nibs 88 are provided, one on that face of the outer arm 56 opposite the depression 86, and one on that face of the web 60 opposite the recess 54. The nibs 88 cooperate, as best shown in FIG. 8, to retain a snap-on cover 90 in covering relation with an open-celled sponge 91. The sponge 91 preferably is formed, for example, from PVC-coated polyurethane. The sponge 91 is disposed directly above a weep hole 92 provided in the web 60. The weep holes 92 allow any water condensing within the wall panel 24 to be discharged at the horizontal joint 28.

Returning to FIG. 4, the web 60 extends beyond the inner arm 58 and terminates in a laterally extending stiffening flange 94 that stiffens the rail means 32 against excessive deflections. When the intermediate stiffener 104 (FIGS. 1 and 6) is used, the stiffening flange 94 also provides structural continuity with the intermediate stiffener 104.

Figure 7A:
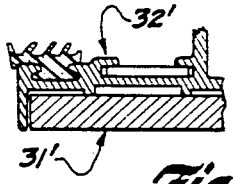

The cover plate 31 is schematically illustrated in FIGS. 7, 8, 14 and 16 to 19, to further indicate that the cover plate 31 may have a construction other than the laminated panel illustrated in FIG. 3. The rib 64 presented by the transverse leg 62 of the rail means 32 is useful in gripping the edge of any cover plate having an edge recess for receiving the same. The rib 64 may be eliminated, as shown in FIG. 7A, when rail means 32' is used with a cover plate 31' that does not have an edge recess. This allows the cover plate 31' to be flush mounted with the rail means 32'.

Reference is now directed to FIGS. 7 and 8. Before the rail means 32 is installed on the cover plate 31, the depression 84 receives a bead 96 of structural silicone adhesive; and the depression 86 receives a strip 98 of double-faced tape. The rail means 32 is installed with the rib 64 engaged in the edge groove 52 of the cover plate 31. A bead 100 of structural silicone adhesive is introduced into the space formed by the inner face 34 of the cover plate 31 and the upturned flange 92 and the angle-shaped member 80. The bead 100 of adhesive extends around the entire inner perimeter of the rail means 32. The strip 98 of adhesive holds the rail means 32 firmly in position until the structural adhesives 96 and 100 have set. The adhesives 96, 100 preferably comprise a two part structural silicone adhesive identified as DOW 983. Alternatively, the adhesive 96, 100 may comprise a one part structural silicone adhesive identified as DOW 795. The DOW 983 and DOW 795 adhesives are manufactured by and are available from The Dow Corning Corporation, Midland, Mich.

As illustrated in FIG. 5, the rail means 32 are mitered at each corner of the wall panel 24. In addition, the lengthwise groove 78 receives a corner connector 102 thereby mechanically connecting each vertical rail means 32 to the upper and lower horizontal rail means 32.

As shown in FIG. 7, the rail means 32A, 32B are secured to the panel inner face 34 of the cover plate 31 at the vertical edges 40, 42 and present vertical recesses 54A, 54B, respectively. As shown in FIG. 8, the rail means 32C, 32D are secured to the panel inner face 34 of the cover plate 31 at the horizontal edges 36, 38 and present upper and lower horizontal recesses 54C, 54D, respectively. The wall panel 24, as configured in FIGS. 7 and 8, is adapted for the horizontal orientation illustrated in FIG. 1. That is, the first gasket groove 70 (FIG. 8) of the lower horizontal recess 54D is not provided with the outer dry gasket seal means 66 as are the vertical recesses 54A, 54B and the upper horizontal recess 54C. The absence of the outer dry gasket seal means 66 allows the venting of water from within the wall panel 24 through weep holes 101 (FIG. 18) provided in a vertical leg 103 of an upper U-shaped portion 132 of the horizontal frame means 120.

The present wall structure 22 was developed utilizing the principles of rain screen and pressure equalization to provide an essentially leak proof wall structure. In brief, the absence of the outer gasket seal means 66 from the gasket groove 70 facilitates the rain screen principle. That is, the bottom edge 25 of the wall panel 24U, for example, shields the weep hole 101 provided in the vertical leg 103 of the upper horizontal frame means 120U, from rain pelting or being blown against the outer surface of the wall structure 22. Again, the absence of the outer gasket seal means 66 and the fact that the lower edge 25 of the wall panel 24U is spaced-apart from the upper horizontal frame means 120U, insures that the recess 54D and all other adjoining recesses 54A, 54B and 54C of the upper wall panel 24U communicate with the outside air. These recesses 54 are therefore pressure equalized with the environment. No differential pressure can exist that would drive water into the wall structure 22 and then into the building 20 (FIG. 1). Any moisture condensing on the inner surface of the cover plate 31 of the upper wall panel 24U is discharged out through the weep hole 92. Any moisture condensing within or water trapped by the upper frame recess 134 is discharged out through the weep hole 101.

Figure 6:
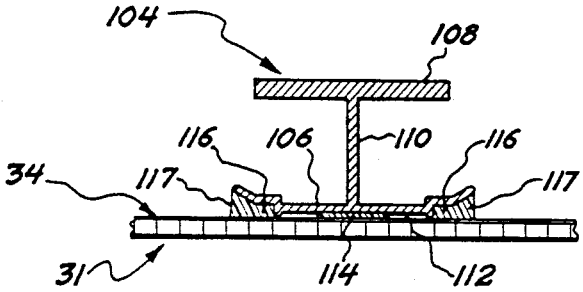
FIG. 6 is across-sectional view, taken along the line 6—6 of FIG. 1, illustrating a wall panel stiffener.

Should the height of the wall panel 24 (FIG. 1) exceed the span limitations of the wall panel 24, an intermediate stiffener 104 is provided. As best shown in FIG. 6, the intermediate stiffener 104 has an H-shaped configuration including an outer flange 106, an inner flange 108 and a connecting web 110. The outer flange 106 includes a depression 112 that receives a strip 114 of double-faced tape for temporarily securing the intermediate stiffener 104 in position on the cover plate 31. The opposite edges of the outer flange 106 cooperate with the panel inner face 34 to define lengthwise recesses 116 each filled with a bead 117 of structural silicone adhesive to positively secure the stiffener 104 to the cover plate 31.

Figure 9:
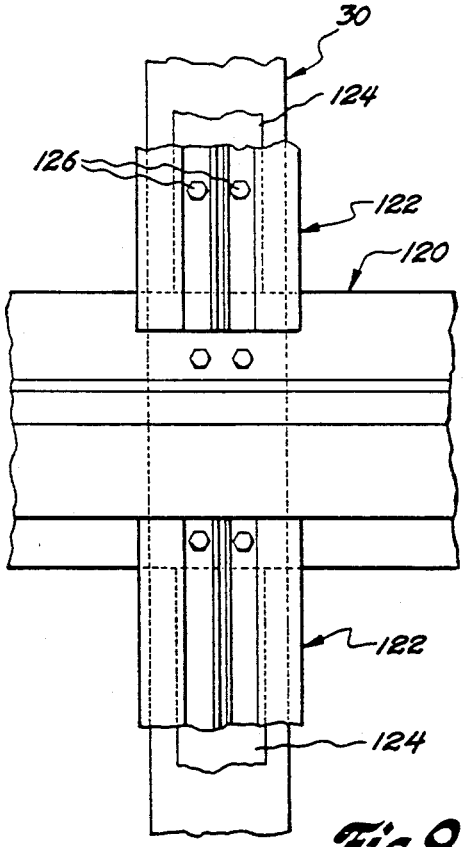
FIG. 9 is a fragmentary elevation view, illustrating frame means to which the building wall panels of FIG. 2 are secured.
Figure 18:
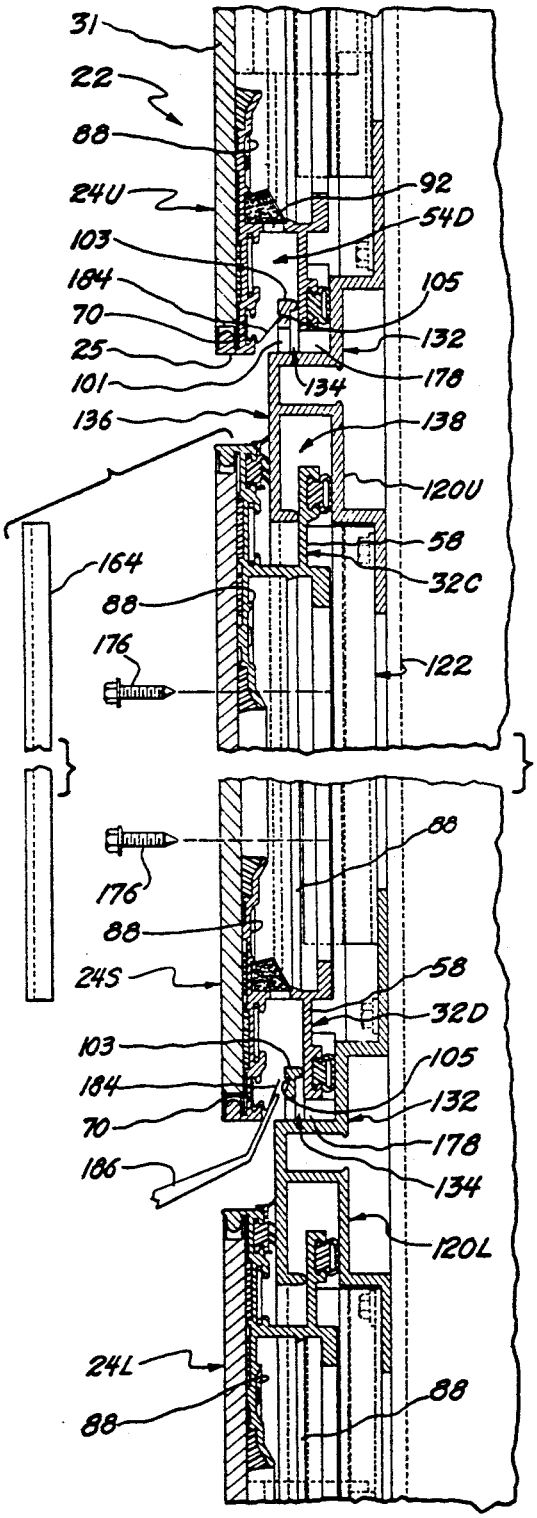
FIG. 18 is a cross-sectional view, taken along the line 18—18 of FIG. 17, further illustrating the curtain wall arrangement of FIG. 17.

Referring to FIG. 9, the present wall panels are supported on structure including horizontal frame means 120, and vertical frame means 122. The horizontal frame means 120 extends substantially uniterruptedly across plural columns 30. The vertical frame means 122, as best shown in FIG. 18, is discontinuous, extending only between vertically adjacent horizontal frame means 120. Since the ends of the vertical frame means 122 overlap the horizontal frame means 120, shim means 124 are introduced between the vertical frame means 122 and the column 30, see FIG. 14, to support the vertical frame means 122 in the region between vertically spaced-apart horizontal frame means 120. Fastener means 126 secure the horizontal frame means 120 and the vertical frame means 122 to the column 30.

Figure 10:
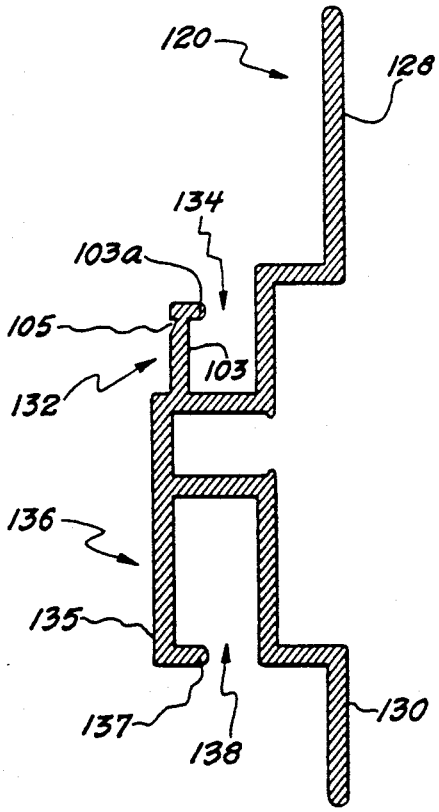
FIG. 10 is a transverse sectional view illustrating the profile of horizontal frame means.

The horizontal frame means 120 (FIG. 10) preferably is formed from aluminum by extrusion process. The horizontal frame means 120 includes oppositely extending upper and lower legs 128, 130 adapted to engage the column 30, see FIG. 14; an upper U-shaped portion 132 providing an upwardly opening upper frame recess 134 and including the vertical leg 103 terminating at its upper end in an inwardly extending rib 103*a* restricting the entrance to the upper frame recess 134; and a lower inverted U-shaped portion 136 providing a downwardly opening lower frame recess 138 and including a downwardly extending leg 135 terminating at its lower end in an inwardly extending rib 137 restricting the entrance to the lower frame recess 138. As will be described, the upper and lower frame recesses 134, 138 are adapted to receive the inner arms 58D, 58C associated with the lower and upper horizontal recesses 54D, 54C of a wall panel 24. A lengthwise notch 105 is formed in the outer face of the vertical leg 103. The notch 105 is adapted to receive and to retain an edge of plural spring clips 184 (shown in FIGS. 5, 18 and 19) provided for a purpose to be described.

Figure 11:
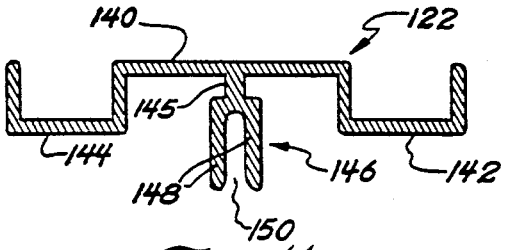
FIG. 11 is a transverse sectional view illustrating the profile of vertical frame means.

The vertical frame means 122 (FIG. 11) preferably is formed from aluminum by extrusion process. The vertical frame means 122 includes a central plate 140 having U-shaped arms 142, 144 extending from opposite longitudinal edges thereof and having a stem 145 projecting outwardly from the central plate 140 with a bifurcated extension 146 projecting outwardly from the stem 145. The bifurcated extension 146 comprises spaced-apart side walls 148 having a lengthwise fastener-receiving groove 150 therebetween.

Figure 12:
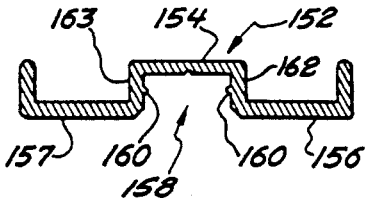
FIG. 12 is a transverse sectional view illustrating the profile of vertical spline means or wall panel retainer.
Figure 13:
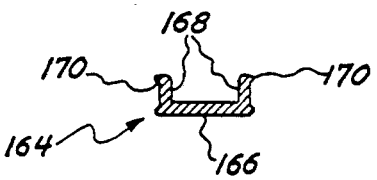
FIG. 13 is a transverse sectional view illustrating the profile of capping means or wall panel retainer cover.

This invention also contemplates the use of vertical spline means 152 (FIG. 12) and cooperating cap means 164 (FIG. 13) both preferably formed from aluminum by extrusion process.

The vertical spline means 152 comprises a plate 154 having U-shaped arms 156, 157 extending from opposite longitudinal edges thereof, and a central depression 158 defined by the plate 154 and the arms 156, 157. Projections 160 are provided on the confronting interior faces of walls 162, 163 of the arms 156, 157. The projections 160 serve to retain the cap means 164 connected to the vertical spline means 152.

The cap means 164 (FIG. 13) has a U-shaped configuration including a web 166 and opposite sides 168 presenting projections 170 at the remote ends thereof. The projections 170 interact with the projections 160 (FIG. 12) of the vertical spline means 152 to retain the cap means 164 in capping relation with the central depression 158, as best shown in FIG. 14.

Figure 14:
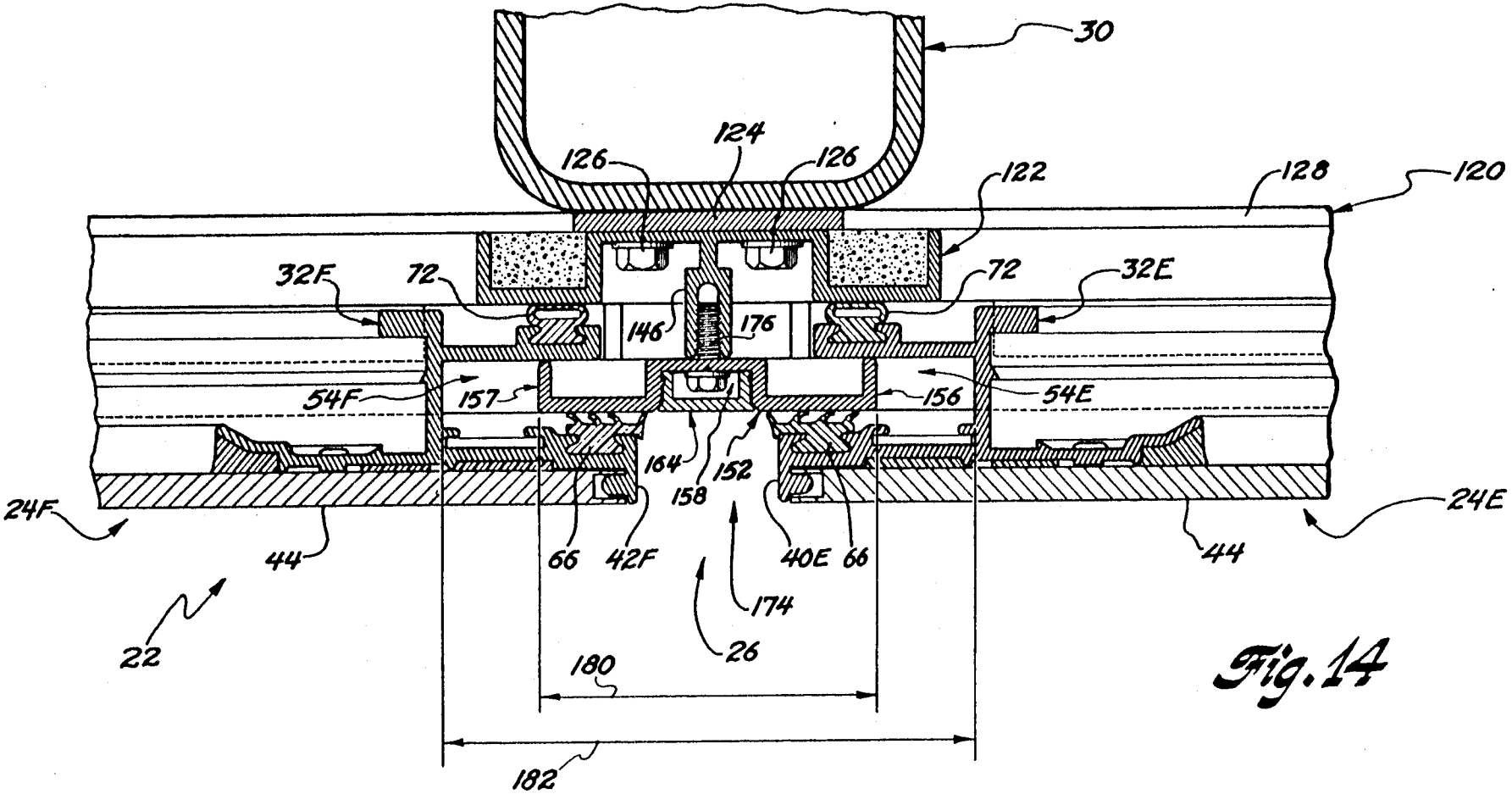
FIG. 14 is a fragmentary cross-sectional view, taken along the line 14—14 of FIG. 1, illustrating a vertical joint between adjacent building wall panels.

FIG. 14 illustrates one of the joints 26 between horizontally adjacent panels 24E, 24F which are spaced-apart such that the confronting panel edges 40E, 42F have a gap 174 therebetween. The vertical spline means 152 spans across the gap 174 with the arms 156, 157 thereof engaged in the vertical recesses 54E, 54F. Fastening means 176, accessible through the gap 174, secures the vertical spline means 152 to the bifurcated extension 146 of the vertical frame means 122. The fastening means 176 has a head residing within the central depression 158 of the vertical spline means 152 and is completely hidden from view by cap means 164. Both the vertical spline means 152 and the cap means 164 reside inboard of the panel outer face 44 and are exposed at the vertical gap 174.

As shown in FIG. 14, the vertical spline means 152 has a width indicated by the dimension line 180. The vertical gap 174 and both of the vertical recesses 54E, 54F have a combined width indicated by the dimension line 182. In accordance with the present invention, the overall arrangement is such that the width 180 of the vertical spline means 152 is less than the sum of the widths (the width 182) of the vertical gap 74 and the vertical recesses 54E, 54F. The difference in the widths 180, 182 is sufficient to permit the vertical spline means 152 to be moved toward one of the rail means, for example the rail means 32F, and thereby release the other rail means, that is the rail means 32E and the wall panel 24E connected thereto, as will be more fully explained.

It will be observed in FIG. 14 that the first and second dry gasket seal means 66, 72 are provided in the form of gaskets preferably formed from EPDM (an ethylenepropylenediamine monomer) or a gasket material sold under the tradename Santoprene®, a proprietary product of Monsanto Chemical Co., St. Louis, Mo. The gasket seal means 66, 72 may also be formed from silicone or neoprene. The first and second dry gasket seal means 66, 72 are of particular configuration. The feathered edges of the outer dry gasket seal means 66 that are in contact with the vertical spline means 152 offers little resistance to movement of the vertical spline means 152. And yet the feathered edges provide a more than adequate seal along the opposite vertical sides and the top of the wall panel 24. The rounded balloon-like configuration of the inner dry gasket seal means 72 provides the primary seal against ingress of air and water through the wall structure 22. It will also be observed in FIG. 14 that the outer dry gasket seal means 66 of the panels 24E, 24F are compressed between the rail means 32E, 32F and the vertical spline means 152; and that the inner dry gasket seal means 72 of both panels 24E, 24F are compressed between the rail means 32E, 32F and the vertical frame means 122. Thus gasket seals are provided against ingress of rain and moisture as well as the infiltration of air.

Figure 15:
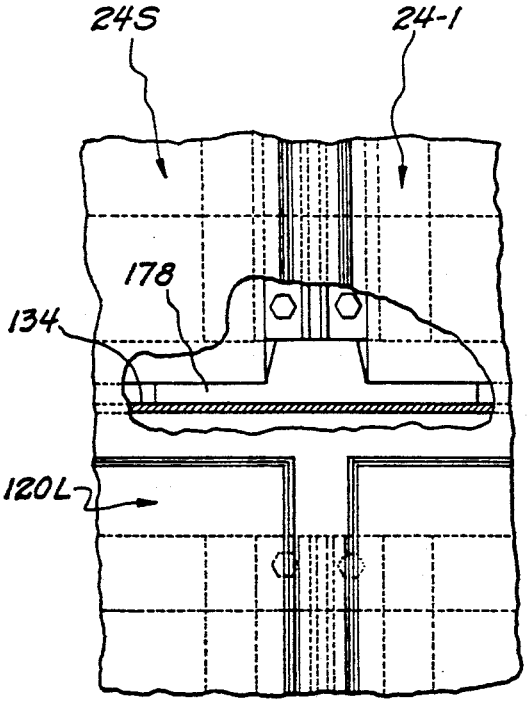
FIG. 15 is a fragmentary elevation view illustrating the use of a setting block in supporting adjacent ones of the building wall panels.

As shown in FIG. 15, a setting block 178 is positioned within the upper frame recess 134 of the horizontal frame means 120L. The setting block 178 is secured in position by any suitable means, such as, by a bead of silicone adhesive (not visible). The horizontally adjacent wall panels 24S, 24-1 rest on the setting block 178. It is to be understood that similar setting blocks are provided at the opposite ends of the horizontally adjacent panels 24S, 24-1.

Figure 16:
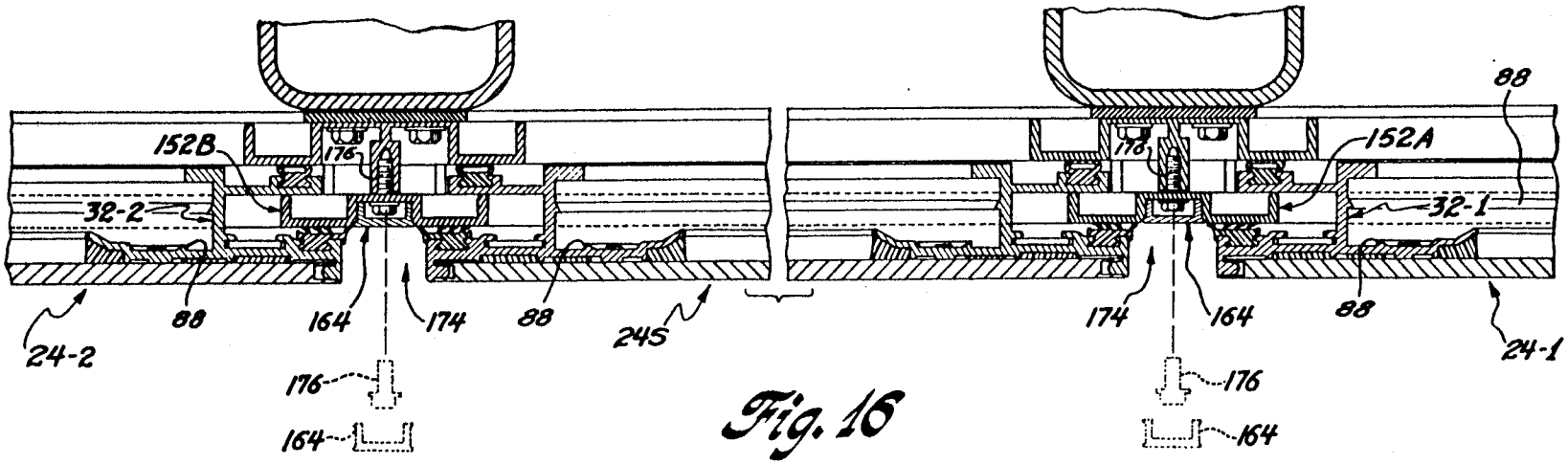
FIG. 16 is a cross-sectional view, taken along the line 16—16 of FIG. 1, illustrating the present curtain wall construction.
Figure 17:
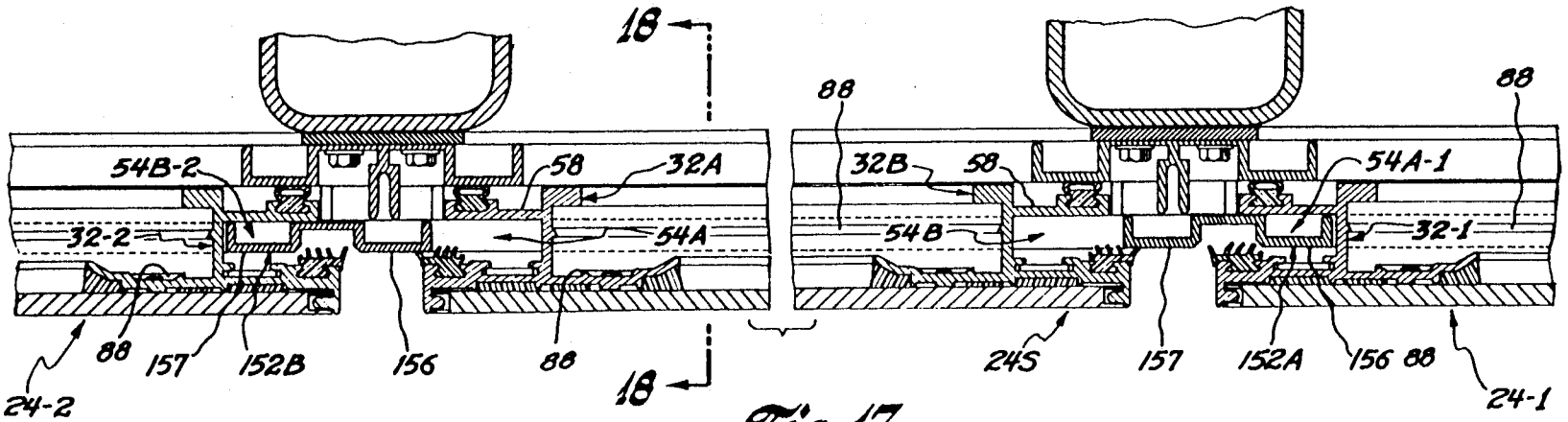
FIG. 17 is a view, similar to FIG. 16, illustrating the arrangement of the curtain wall just prior to removal of a selected one of the building wall panels.

FIGS. 16 and 17 are horizontal sectional views of the wall structure 22, illustrating fragments of three horizontally adjacent wall panels. The center wall panel will be the panel selected for replacement and will be identified by the numeral 24S. The panels to the right and to the left of the selected panel 24S will be identified by the numerals 24-1 and 24-2, respectively.

Figure 19:
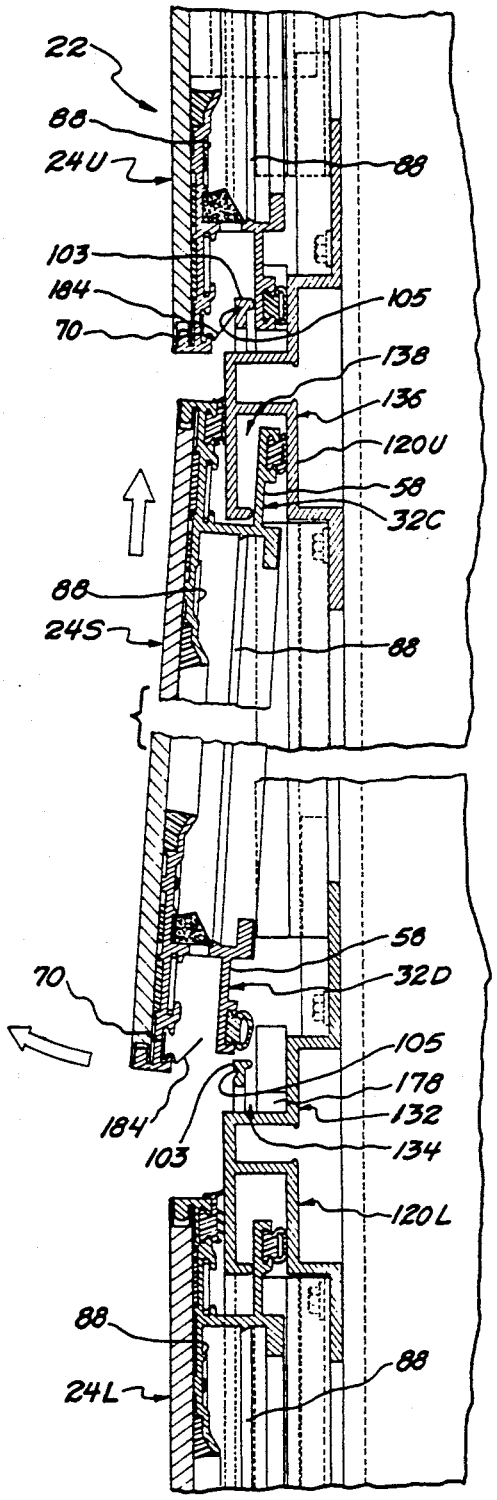
FIG. 19 is a view, similar to FIG. 18, illustrating the removal of the selected one of the building wall panels.

FIGS. 18 and 19 are vertical sectional views of the wall structure 22, illustrating the selected panel 24S, a superjacent or upper panel 24U and a subjacent or lower panel 24L.

Before discussing the ease with which the selected panel 24S can be removed, an explanation of how the wall panels 24 interconnect with the horizontal frame means 120 is in order.

Referring to FIG. 19, the inner leg 58 of the upper rail means 32C is inserted into the lower frame recess 138 of the upper horizontal frame means 120U. It will be observed that the first gasket groove 70 along the bottom edge 25 of the wall panel 24S is provided with at least two of the spring clips 184—only one spring clip 184 being visible in FIG. 19. The lower end of the selected panel 24S is pushed inwardly until the inner arm 58 of the lower rail means 32D clears the U-shaped portion 132 of the lower horizontal frame means 120L. Thereafter, the selected panel 24S is lowered such that it rests on and is supported by the setting blocks 178 (FIGS. 15, 18). At the same time, the spring clip 184, being biased toward the vertical leg 103, engages the notch 105 as shown in FIGS. 18 and 19 in connection with the upper wall panel 24U and the upper horizontal frame means 120U. As shown in FIG. 18, the inner arms 58 of the upper and lower rail means 32C, 32D are captive within the lower and upper frame recesses 138, 134 of the upper and lower horizontal frame means 120U, 120L, respectively. And yet the vertical spline means 152 (FIG. 14) and the upper and lower horizontal frame means 120U, 120L retain each wall panel 24 in such a manner that the wall panel 24 is free to undergo thermal expansion and contraction both horizontally and vertically.

In this connection, it should be understood that the spring clips 184 constitute resilient means extending between a lower edge portion of the wall panel 24 and the adjacent horizontal frame means 120 thereby urging the wall panel 24 downwardly relative to the horizontal frame means 120. As seen in FIG. 18, the spring clips 184 urge the upper wall panel 24U downwardly against the setting blocks 178, while allowing the upper wall panel 24U to undergo vertical thermal expansion and contraction.

Referring now to FIGS. 16 and 17, to remove the selected wall panel 24S, the cap means 164 and fastener means 176 must first be removed, as shown in dotted outline in FIG. 16., so as to release the vertical spline means 152A and 152B. This is easily done since both are accessible through the vertical gap 174 (FIG. 16). Thereafter, the vertical spline means 152A, for example, is moved to the right, as viewed in FIG. 17, toward the rail means 32-1 of the adjacent wall panel 24-1. The vertical spline means 152A is moved far enough so that the U-shaped arm 157 thereof disengages from the vertical recess 54B and clears the inner arm 58 of the rail means 32B thereby releasing the rail means 32B or the right side of the selected panel 24S. Likewise, the vertical spline means 152B is moved to the left, as viewed in FIG. 17, toward the rail means 32-2 of the adjacent panel 24-2. The vertical spline means 152B is moved far enough so that the U-shaped arm 156 thereof disengages from the vertical recess 54A and clears the inner arm 58 of the rail means 32A thereby releasing the rail means 32A or the left side of the selected panel 24S.

Referring to FIG. 18, each of the spring clips 184 is disengaged from the notch 105 by means of a suitable tool schematically illustrated at 186. Once the vertical sides of the selected panel 24S and the spring clips 184 have been released, it is an easy matter, as shown in FIG. 19, to lift the selected panel 24S until the inner arm 58 of the lower rail means 32D clears the upper U-shaped recess 134 of the lower horizontal frame means 120L. The lower end of the selected panel 24S can then be pulled outwardly to clear the lower horizontal frame means 120L and then lowered to disengage the upper rail means 32C from the upper horizontal frame means 120U.

It should be readily apparent that a new panel 24S may installed by reversing the foregoing procedure.

It is firmly believed that the present invention provides—for the first time in the building arts—a curtain wall system utilizing a dry gasket seal system and which incorporates the ability to replace panels in a non-sequential manner.

We claim:

1. A vertical joint between horizontally adjacent wall panels of a wall structure, comprising:

said panels having inner and outer panel faces, and presenting spaced-apart vertical edges with a vertical gap therebetween;

rail means secured to said inner panel faces at said vertical edges and presenting vertical recesses open at and extending inwardly from said vertical edges; and vertical spline means spanning across said vertical gap, engaging said vertical recesses, and being movable out of engagement with either of said vertical recesses thereby releasibly retaining said panels.

2. The vertical joint as defined in claim 1 including:

fastening means accessible through said vertical gap, releasibly securing said vertical spline means to structure inboard of said wall panels.

3. The vertical joint as defined in claim 2 wherein said structure comprises:

a vertical column;

vertical frame means secured to said column and having an outwardly projecting bifurcated extension; and wherein said fastening means secures said spline means to said bifurcated extension.

4. The vertical joint as defined in claim 2 wherein:

said vertical spline means presents a central depression;

said fastening means resides in said central depression; and including cap means capping substantially the entire length of said central depression.

5. The vertical joint as defined in claim 4 wherein said cap means resides inboard of said panel outer faces.

6. The vertical joint as defined in claim 1 wherein said vertical spline means is exposed at said vertical gap.

7. The vertical joint as defined in claim 1 including:

dry gasket seal means compressed between said rail means and said vertical spline means.

8. The vertical joint as defined in claim 7 wherein said gasket dry seal means is connected to said rail means.

9. The vertical joint as defined in claim 1 wherein said vertical spline means has a spline width which is less than the sum of the widths of said vertical gap and said vertical recesses by an amount sufficient to permit said spline means to be moved toward one of said rail means thereby disengaging said spline means from and releasing the other of said rail means and said panel associated therewith for removal from said wall structure.

10. The vertical joint as defined in claim 9 wherein said rail means providing said vertical recesses includes:

an inner arm spaced from and generally parallel with said inner face of said panel, said inner arm having an outer edge which is laterally inwardly offset from the vertical edge of said panel.

11. The vertical joint as defined in claim 9 wherein said rail means providing said vertical recesses, each have a U-shaped configuration including:

an outer arm secured to said inner face of said panel;

an inner arm spaced from and generally parallel with said outer arm and having a width that is less than that of said outer arm; and a central web joining those ends of said outer arm and said inner arm remote from the adjacent one of said vertical edges of said panel.

12. The vertical joint as defined in claim 11 wherein said inner arm has an outer edge laterally inwardly offset from the adjacent one of said vertical edges.

13. A system for erecting a plurality of panels to form a wall structure having horizontally adjacent panels and vertically adjacent panels, each pair of said horizontally adjacent panels having a vertical gap there between, said system comprising:

each of said panels having an inner face and an outer face;

rail means secured to the perimeter of said inner face of each of said panels providing horizontal top and bottom recesses and vertical side recesses;

horizontal frame means engaging said top and bottom recesses, supporting said vertically adjacent panels in vertically spaced-apart relation with horizontal gaps therebetween;

vertical frame means engaged by said rail means; and vertical spline means, each spanning across one said vertical gap, engaging said vertical side recesses and being movable out of engagement with either of vertical side recesses thereby releasibly retaining said horizontally adjacent panels.

14. The system as defined in claim 13 wherein each of said horizontal frame means is exposed at one of said horizontal gaps; and each of said vertical spline means is exposed at one of said vertical gaps.

15. The system as defined in claim 13 wherein each of said vertical spline means has a spline width which is less than the sum of the widths of said vertical gap and said vertical recesses by an amount sufficient to permit the spline means on opposite sides of a selected one of said panels to be moved laterally outwardly away from said selected one of said panels toward the rail means of adjacent panels thereby to be disengaged from said selected one of said panels and releasing the same for removal from said wall structure.

16. The system as defined in claim 15 wherein said rail means providing said vertical recesses each include an inner arm spaced from and generally parallel with said inner face, said inner arm having an outer edge which is laterally inwardly offset from the vertical edge of said panel.

17. The system as defined in claim 15 wherein said rail means providing said vertical recesses each have a U-shaped configuration including:

an outer arm secured to said inner face of said panel;

an inner arm spaced from and generally parallel with said outer arm; and a central web joining those ends of said outer arm and said inner arm remote from said vertical edges of said panel.

18. The system as defined in claim 17 wherein said inner arm has an outer edge which is laterally inwardly offset from the adjacent one of said vertical edges.

19. The system as defined in claim 13 wherein said horizontal top and bottom recesses of each of said panels are defined, in part, by inner arms connected to and spaced-apart from said inner face;

each of said horizontal frame means presenting a lower frame recess receiving the inner arm of a subjacent one of said panels, and an upper frame recess receiving the inner arm of and supporting a superjacent one of said panels; and said lower frame recess having a vertical depth grater than that of said upper frame recess.

20. The system as defined in claim 13 wherein each of said panels has a lower horizontal edge portion, and said system includes:

resilient means extending between said lower edge portion of each of said panels and the adjacent horizontal frame means to urge said panel downwardly relative to said horizontal frame means.

21. The system as defined in claim 20 wherein said resilient means comprises at least one spring clip connected to said lower edge of said panel.

22. The system as defined in claim 13 including fastening means releasibly securing each of said vertical spline means to one of said vertical frame means.

* * * * *